US010238266B2

(12) United States Patent
Carlson et al.

(10) Patent No.: US 10,238,266 B2
(45) **Date of Patent: *Mar. 26, 2019**

(54) DISHWASHER

(71) Applicant: Whirlpool Corporation, Benton Harbor, MI (US)

(72) Inventors: Christopher J. Carlson, Watervliet, MI (US); Vincent P. Gurubatham, Saint Joseph, MI (US); Jay C. Landsiedel, Saint Joseph, MI (US); Edward L. Thies, Creola, OH (US); Chad T. Vanderroest, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 132 days.

This patent is subject to a terminal disclaimer.

(21) Appl. No.: 15/435,965

(22) Filed: Feb. 17, 2017

(65) Prior Publication Data

US 2017/0156563 A1 Jun. 8, 2017

Related U.S. Application Data

(63) Continuation of application No. 14/611,675, filed on Feb. 2, 2015, now Pat. No. 9,615,720, which is a (Continued)

(51) Int. Cl.

| | |
|---|---|
| ***A47L 15/42*** | (2006.01) |
| ***A47L 15/16*** | (2006.01) |
| ***A47L 15/22*** | (2006.01) |

(52) U.S. Cl.

CPC ..... *A47L 15/4217* (2013.01); *A47L 15/16* (2013.01); *A47L 15/22* (2013.01); *A47L 15/4221* (2013.01); *A47L 15/4278* (2013.01)

(58) Field of Classification Search

CPC ..... A47L 15/16; A47L 15/18; A47L 15/20; A47L 15/22; A47L 15/23; A47L 15/4217; (Continued)

(56) References Cited

U.S. PATENT DOCUMENTS

| | | | |
|---|---|---|---|
| 1,598,352 | A | 8/1926 | Kehoe et al. |
| 1,897,821 | A | 2/1933 | Poli |

(Continued)

FOREIGN PATENT DOCUMENTS

| | | | |
|---|---|---|---|
| BR | PI0505649 | A | 9/2006 |
| BR | P10506303 | A | 7/2007 |

(Continued)

OTHER PUBLICATIONS

Machine Translation of Heissmeier, DE 2911005 A1, Sep. 1980. (Year: 1980).*

(Continued)

*Primary Examiner* — David G Cormier
(74) *Attorney, Agent, or Firm* — McGarry Bair PC

(57) ABSTRACT

A dishwasher having a tub defining a wash chamber, dish racks located within the wash chamber, and pump assembly for recirculating wash liquid is further provided with a rotating spray arm located configured to direct a spray of liquid into the wash chamber to define a first wash zone and at least one nozzle configured to direct a spray of liquid into the wash chamber to define a second wash zone.

35 Claims, 5 Drawing Sheets

Related U.S. Application Data continuation of application No. 14/101,800, filed on Dec. 10, 2013, now Pat. No. 9,474,434, which is a continuation of application No. 13/940,997, filed on Jul. 12, 2013, now Pat. No. 8,801,868, and a continuation of application No. 13/941,011, filed on Jul. 12, 2013, now Pat. No. 8,871,031, said application No. 13/940,997 is a continuation of application No. 13/834,280, filed on Mar. 15, 2013, now Pat. No. 8,764,908, said application No. 13/941,011 is a continuation of application No. 13/834,187, filed on Mar. 15, 2013, now Pat. No. 8,753,454, said application No. 13/940,997 is a continuation of application No. 13/834,238, filed on Mar. 15, 2013, now Pat. No. 8,808,467, and a continuation of application No. 13/834,187, said application No. 13/941,011 is a continuation of application No. 13/834,238, and a continuation of application No. 13/834,280, said application No. 13/834,238 is a continuation of application No. 13/360,831, filed on Jan. 30, 2012, now Pat. No. 8,454,763, said application No. 13/834,187 is a continuation of application No. 13/360,831, said application No. 13/834,280 is a continuation of application No. 13/360,831, said application No. 13/360,831 is a continuation of application No. 13/096,317, filed on Apr. 28, 2011, now Pat. No. 8,187,390, and a continuation of application No. 13/096,292, filed on Apr. 28, 2011, now Pat. No. 8,137,479, said application No. 13/096,317 is a continuation of application No. 12/538,394, filed on Aug. 10, 2009, now Pat. No. 7,947,132, said application No. 13/096,292 is a continuation of application No. 12/538,394, said application No. 12/538,394 is a continuation of application No. 12/101,302, filed on Apr. 11, 2008, now Pat. No. 7,594,513, said application No. 12/101,302 is a continuation of application No. 10/463,263, filed on Jun. 17, 2003, now Pat. No. 7,445,013.

(58) Field of Classification Search

CPC ..... A47L 15/4219; A47L 15/4221; A47L 15/4278; A47L 15/428

See application file for complete search history.

(56) References Cited

U.S. PATENT DOCUMENTS

| | | | |
|---|---|---|---|
| 2,407,533 | A | 9/1946 | Brock |
| 2,918,927 | A | 12/1959 | Clearman |
| 3,060,944 | A | 10/1962 | Brollo |
| 3,095,885 | A | 7/1963 | Hertell |
| 3,217,721 | A | 11/1965 | Hertel |
| 3,253,784 | A | 5/1966 | Long et al. |
| 3,285,779 | A | 11/1966 | Dunham |
| 3,468,486 | A | 9/1969 | Mercer |
| 3,586,011 | A | 6/1971 | Mazza |
| 3,648,931 | A | 3/1972 | Jacobs |
| 3,718,149 | A | 2/1973 | Mazza |
| 3,828,818 | A | 8/1974 | Hunt |
| 3,915,180 | A | 10/1975 | Jacobs |
| 4,094,702 | A | 6/1978 | Rabuffetti |
| 4,172,463 | A | 10/1979 | Woolley et al. |
| 4,279,384 | A | 7/1981 | Yamamoto |
| 4,320,781 | A | 3/1982 | Bouvet et al. |
| 5,131,419 | A | 7/1992 | Roberts |
| 5,264,043 | A | 11/1993 | Milocco |
| 5,331,986 | A | 7/1994 | Lim et al. |
| 5,494,062 | A | 2/1996 | Springer |
| 5,497,798 | A | 3/1996 | Fritz et al. |
| 5,542,443 | A | 8/1996 | Yura et al. |
| 5,823,211 | A | 10/1998 | Wilhelmstatter et al. |
| 5,849,101 | A | 12/1998 | Edwards et al. |
| 6,003,529 | A | 12/1999 | Perry, Jr. |
| 6,431,188 | B1 | 8/2002 | Laszczewski, Jr. et al. |
| 6,432,216 | B1 | 8/2002 | Thies |
| 6,491,049 | B1 | 12/2002 | Tuller et al. |
| 6,666,220 | B2 | 12/2003 | Spanyer et al. |
| 6,869,029 | B2 | 3/2005 | Ochoa, Sr. et al. |
| 7,055,537 | B2 | 6/2006 | Elick et al. |
| 7,270,132 | B2 | 9/2007 | Inui et al. |
| 7,331,356 | B2 | 2/2008 | Vanderroest et al. |
| 7,445,013 | B2 | 11/2008 | Vanderroest et al. |
| 7,475,696 | B2 | 1/2009 | Vanderroest et al. |
| 7,523,758 | B2 | 4/2009 | Vanderroest et al. |
| 7,594,513 | B2 | 9/2009 | Vanderroest et al. |
| 7,947,132 | B2 | 5/2011 | Vanderroest et al. |
| 8,137,479 | B2 | 3/2012 | Vanderroest et al. |
| 8,187,390 | B2 | 5/2012 | Vanderroest et al. |
| 8,454,762 | B2 | 6/2013 | Vanderroest et al. |
| 8,454,763 | B2 | 6/2013 | Vanderroest et al. |
| 2003/0168087 | A1 | 9/2003 | Inui et al. |
| 2004/0173249 | A1 | 9/2004 | Assman et al. |
| 2004/0255992 | A1 | 12/2004 | Rudiger |
| 2005/0022847 | A1 | 2/2005 | Nito et al. |
| 2005/0150529 | A1 | 7/2005 | Vanderroest et al. |
| 2005/0224098 | A1 | 10/2005 | Fujii et al. |
| 2006/0054198 | A1 | 3/2006 | Choi |
| 2007/0056613 | A1 | 3/2007 | Haas et al. |
| 2007/0119485 | A1 | 5/2007 | Gunnerson et al. |
| 2009/0159103 | A1 | 6/2009 | Gillum et al. |
| 2011/0114139 | A1 | 5/2011 | Buesing et al. |
| 2012/0111376 | A1 | 5/2012 | Worrasangasilpa et al. |
| 2012/0125381 | A1 | 5/2012 | Vanderroest et al. |
| 2012/0125382 | A1 | 5/2012 | Vanderroest et al. |
| 2012/0138110 | A1 | 6/2012 | Chen et al. |
| 2013/0092194 | A1 | 4/2013 | Carlson et al. |
| 2013/0139859 | A1 | 6/2013 | Park et al. |

FOREIGN PATENT DOCUMENTS

| | | | |
|---|---|---|---|
| CA | 2527846 | A1 | 6/2006 |
| CA | 2527848 | A1 | 6/2006 |
| CN | 1182570 | A | 5/1998 |
| DE | 7417444 | U | 10/1974 |
| DE | 2911005 | A1 | 9/1980 |
| DE | 3403359 | A1 | 8/1985 |
| DE | 19544985 | A1 | 6/1996 |
| DE | 10124645 | A1 | 12/2001 |
| DE | 102006012453 | A1 | 10/2006 |
| DE | 102012217566 | A1 | 3/2013 |
| EP | 0291713 | A1 | 11/1988 |
| EP | 0517015 | A1 | 12/1992 |
| EP | 0755650 | A1 | 1/1997 |
| EP | 0786230 | A2 | 7/1997 |
| EP | 795292 | A2 | 9/1997 |
| EP | 0796587 | A2 | 9/1997 |
| EP | 1040787 | A1 | 10/2000 |
| EP | 1252856 | A2 | 10/2002 |
| EP | 1264570 | A1 | 12/2002 |
| EP | 1488730 | A1 | 12/2004 |
| EP | 1676520 | A2 | 7/2006 |
| EP | 1676521 | A2 | 7/2006 |
| EP | 2583611 | A2 | 4/2013 |
| ES | 2321711 | T3 | 6/2009 |
| ES | 2340859 | T3 | 6/2010 |
| GB | 668181 | A | 3/1952 |
| GB | 2295535 | A | 6/1996 |
| JP | 09285435 | A | 11/1997 |
| JP | 11076127 | A | 3/1999 |
| JP | 2001218721 | A | 8/2001 |
| JP | 2002065562 | A | 3/2002 |
| JP | 2002219088 | A | 8/2002 |
| JP | 2007105210 | A | 4/2007 |
| KR | 19950003025 | | 2/1995 |
| KR | 19970064554 | | 10/1997 |
| KR | 19980031929 | | 8/1998 |
| KR | 19990031442 | | 7/1999 |
| KR | 20040006218 | A | 1/2004 |

(56) References Cited

FOREIGN PATENT DOCUMENTS

| | | | |
|---|---|---|---|
| KR | 200366704 | | 10/2004 |
| KR | 20050122359 | A | 12/2005 |
| KR | 20060013790 | A | 2/2006 |
| KR | 20060087396 | A | 8/2006 |
| KR | 100842370 | B1 | 6/2008 |
| KR | 20080083911 | A | 9/2008 |
| KR | 20090014510 | A | 2/2009 |
| MX | PA05013870 | A | 6/2006 |
| MX | PA05013873 | A | 6/2006 |
| WO | 0022973 | A1 | 4/2000 |
| WO | 2004058035 | A1 | 7/2004 |

OTHER PUBLICATIONS

NPL USPTO Notice of Intent to Issue a Reexam Certificate for U.S. Appl. No. 96/000,044, dated Mar. 19, 2014.
NPL Supplemental Examination as filed for U.S. Appl. No. 96/000,044, dated Oct. 25, 2013.
Bosch User Manual for Dishwasher, p. 22, Downloaded From boschappliances.com on Feb. 15, 2005.
The Perfect Ten, 2005 American Building Product Awards, Home Magazine, homemag.com, Published Feb. 2005.
Asko Unveils New Dishwasher, Appliance Magazine, Published May 8, 2003, Downloaded From appliancemagazine.com Sep. 26, 2005.
Dishwashers, Power At a Price, Consumer Reports, p. 34, Published Mar. 2005.
Bosch SHU43 Built-In Dishwasher, epinions.com, Published Jan. 26, 2001.
First Look, Power Washer, p. 91, Good Housekeeping Magazine, Published Sep. 2004.
European Search Report for Corresponding EP12158456.9, dated Dec. 6, 2017.

* cited by examiner

DISHWASHER

CROSS-REFERENCE TO RELATED APPLICATION(S)

This application is a continuation of U.S. patent application Ser. No. 14/611,675, filed Feb. 2, 2015, now U.S. Pat. No. 9,615,720, issued Apr. 11, 2017, which is a continuation of U.S. patent application Ser. No. 14/101,800, filed Dec. 10, 2013, now U.S. Pat. No. 9,474,434, issued Oct. 25, 2016, which is a continuation of U.S. patent application Ser. No. 13/940,997, filed Jul. 12, 2013, now U.S. Pat. No. 8,801,868, issued Aug. 12, 2014, and U.S. patent application Ser. No. 13/941,011, filed Jul. 12, 2013, now U.S. Pat. No. 8,871,031, issued Oct. 28, 2014, both of which are continuations of U.S. patent application Ser. No. 13/834,187, filed Mar. 15, 2013, now U.S. Pat. No. 8,753,454, issued Jun. 17, 2014, U.S. patent application Ser. No. 13/834,238, filed Mar. 15, 2013, now U.S. Pat. No. 8,808,467, issued Aug. 19, 2014, and U.S. patent application Ser. No. 13,834,280, filed Mar. 15, 2013, now U.S. Pat. No. 8,764,908, issued Jul. 1, 2014, all three of which are continuations of U.S. patent application Ser. No. 13/360,831, filed Jan. 30, 2012, now U.S. Pat. No. 8,454,763, issued Jun. 4, 2013, which is a continuation of U.S. patent application Ser. No. 13/096,292, filed Apr. 28, 2011, now U.S. Pat. No. 8,137,479, issued Mar. 20, 2012, and U.S. patent application Ser. No. 13/096,317, filed Apr. 28, 2011, now U.S. Pat. No. 8,187,390, issued May 29, 2012, both of which are continuations of U.S. patent application Ser. No. 12/538,394, filed Aug. 10, 2009, now U.S. Pat. No. 7,947,132, issued May 24, 2011, which is a continuation of U.S. patent application Ser. No. 12/101,302, filed Apr. 11, 2008, now U.S. Pat. No. 7,594,513, issued Sep. 29, 2009, which is a continuation of U.S. patent application Ser. No. 10/463,263, filed Jun. 17, 2003, now U.S. Pat. No. 7,445,013, issued Nov. 4, 2008, all of which are incorporated herein by reference.

BACKGROUND OF THE INVENTION

Field of the Invention

The present invention relates to a dishwasher.

Background

Modern dishwashers include a tub and an upper and lower rack or basket for supporting soiled dishes within the tub. A pump is provided for re-circulating wash liquid throughout the tub to remove soils from the dishes. Typically, larger dishes such as casserole dishes which have a propensity to be heavily soiled are carried on the lower rack and lighter soiled dishes such as cups and glasses are provided on an upper rack. The racks are generally configured to be moveable in or out of the tub for loading and unloading.

One of problems associated with the typical modern dishwasher is that the dishes receive somewhat uniform wash treatment no matter their positioning within a rack in the dishwasher. For example, in a typical dishwasher, a lower wash arm rotates about a vertical axis and is provided beneath the lower rack for cleaning the dishes on the lower rack and an upper wash arm is provided beneath the upper rack for cleaning the dishes on the upper rack. Dishes in the upper rack receive somewhat uniform wash treatment and dishes in the lower rack receive somewhat uniform wash treatment. Accordingly, lightly soiled dishes in either dish rack are subject to the same wash performance as the highly soiled dishes in the same wash rack, which can lead to poor wash performance of the highly soiled dishes. As a result, it would be advantageous to provide a dishwasher with a second or concentrated wash zone for washing larger dishes such as the casserole dishes, which are more likely to be heavily soiled.

Another problem associated with the modern dishwasher is that to achieve optimal wash performance of heavily soiled, larger dishes, the dishes may need to be loaded with the surface that needs to be washed face down. The face down approach allows the lower spray arm to reach the heavily soiled surface. Accordingly, it would be advantageous if the dishwasher could be provided with a second wash zone that allowed the heavily soiled dishes to be loaded in an upright position, thereby optimizing the number of dishes that can be loaded in the dishwasher on any given cycle. Finally, it would also be advantageous if the dishwasher allowed for a customized wash cycle option which optimized the use of the second wash zone.

SUMMARY OF THE INVENTION

A dishwasher according to one aspect of the invention includes a tub at least partially defining a wash chamber, a lower dish rack located within the wash chamber, an upper dish rack located within the wash chamber above the lower dish rack, a lower rotating spray arm located within the wash chamber beneath the lower dish rack and configured to direct a spray of liquid into the wash chamber to define a first wash zone, an upper rotating spray arm located within the wash chamber beneath the upper dish rack, at least one nozzle having at least one aperture located in the wash chamber beneath the lower dish rack and configured to direct a spray of liquid into the wash chamber to define a second wash zone, a pump assembly in fluid communication with the tub to draw in liquid from the tub and comprising a pump output for outputting the drawn-in liquid, and a diverter valve fluidly coupling the pump to the lower rotating spray arm, upper rotating spray arm, and at least one nozzle, and selectively fluidly coupling the pump output to at least one of the lower rotating spray arm, upper rotating spray arm, or at least one nozzle.

Still other aspects of the present invention will become apparent to those skilled in the art from the following detailed description, which is simply by way of illustration several of the best modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and together with their description serve to explain the principles of the invention. In the drawings.

Figure 4A:
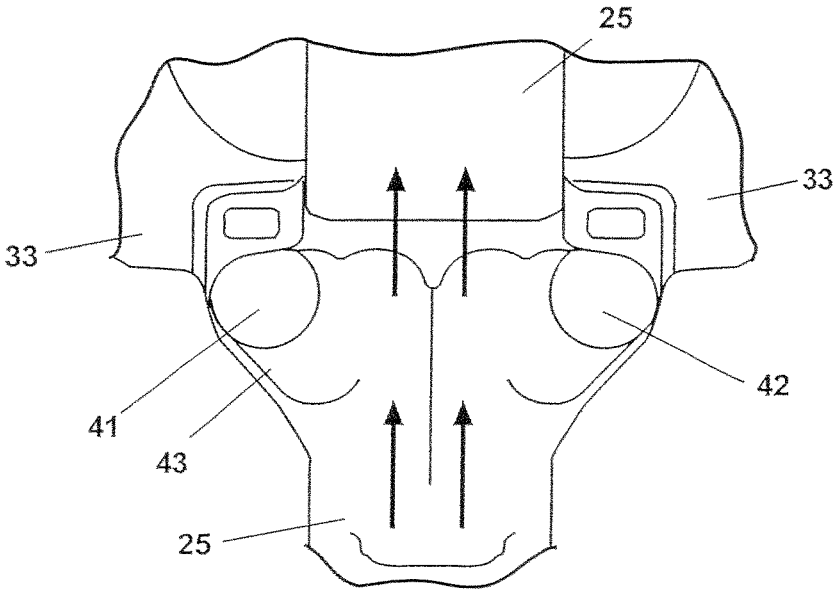
Figure 4B:
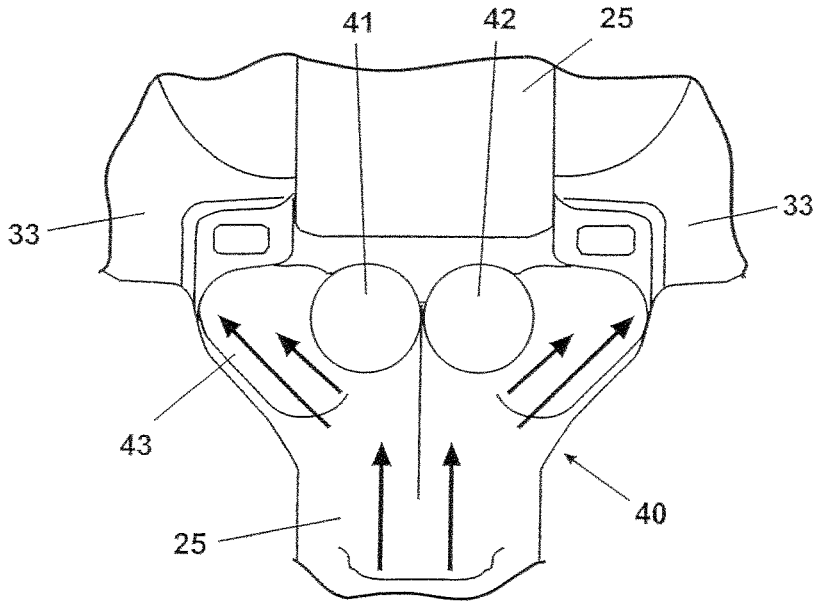
Figure 5:
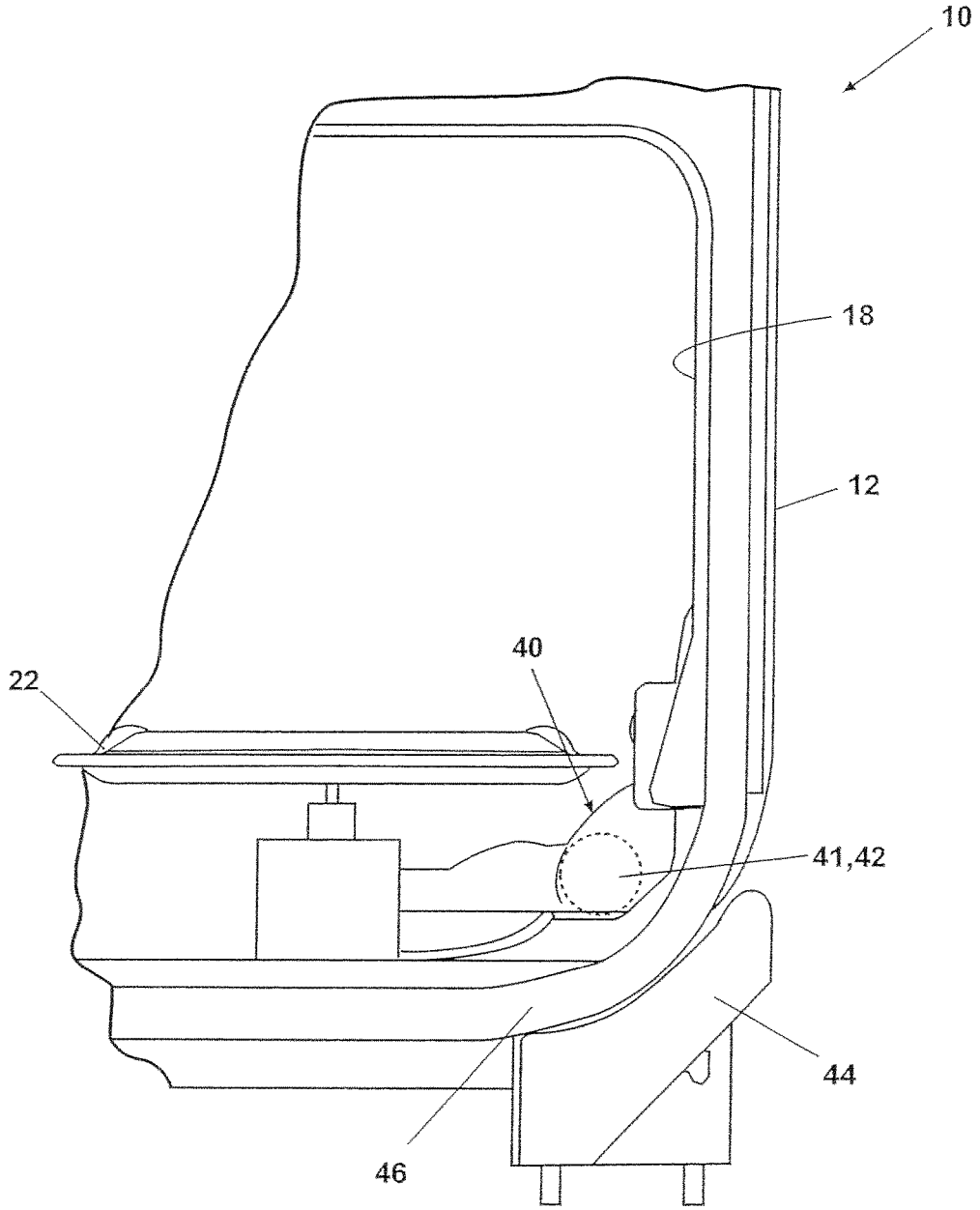

FIG. **4*a*** is a schematic view of a first position of a valve for selectively diverting wash liquid to a supply tube in accordance with the exemplary embodiment of the present invention;

FIG. 4*b* is a schematic view of a second position of a valve for selectively diverting wash liquid to a spray manifold in accordance with the exemplary embodiment of the present invention; and FIG. 5 is a schematic view of valve and actuator as contemplated by the present invention.

DETAILED DESCRIPTION

Figure 1:
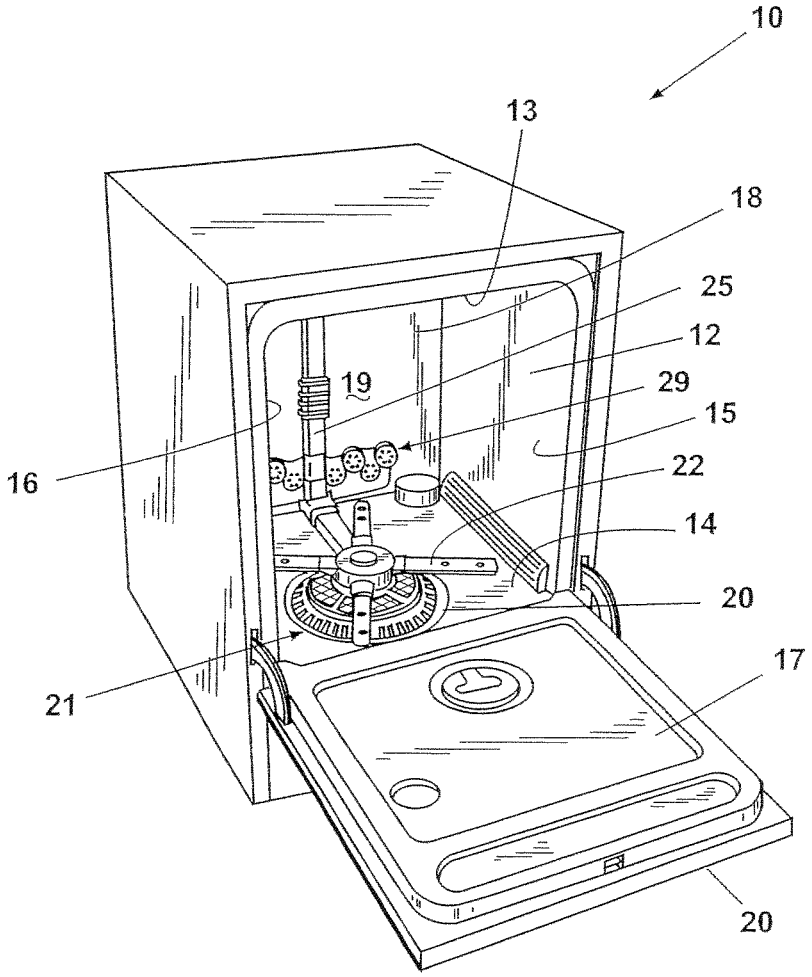
FIG. 1 is a perspective view of a dishwasher having multiple wash zones in accordance with an exemplary embodiment of the present invention.
Figure 2:
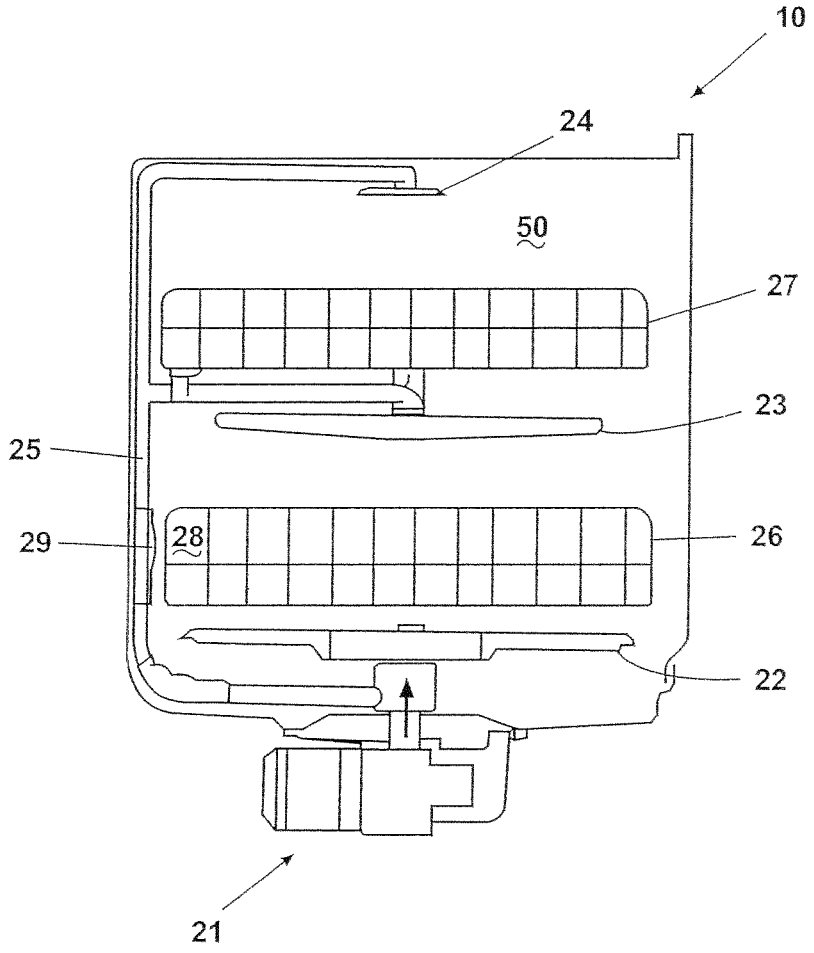
FIG. 2 is a schematic, cross-sectional view of the dishwasher shown in FIG. 1, showing the dish racks mounted in the tub, upper and lower spray arm assemblies and a spray manifold as contemplated by the present invention.

Referring now to the drawings in detail, wherein like numerals indicate the same elements throughout the views, FIGS. 1 and 2 illustrate an exemplary embodiment of a multiple wash zone dishwasher 10 in accordance with the present invention. In the embodiment shown generally in FIGS. 1 and 2, the dishwasher generally designated as 10 includes an interior tub 12 having a top wall 13, bottom wall 14, two side walls 15 and 16, a front wall 17 and a rear wall 18, which form an interior wash chamber or dishwashing space 19 for washing dishes. As one of skill in the art will appreciate, the front wall 17 may be the interior of door 20, which may be pivotally attached to the dishwasher for providing accessibility to the dishwashing space 19 for loading and unloading dishes or other washable items. While the present invention is described in terms of a conventional dishwashing unit as illustrated in FIG. 1, it could also be implemented in other types of dishwashing units such as in-sink dishwashers or drawer dishwashers.

The bottom wall 14 of the dishwasher may be sloped to define a lower tub region or sump 20 of the tub. A pump assembly 21 may be located in or around a portion of the bottom wall 14 and in fluid communication with the sump 20 to draw wash liquid from the sump 20 and to pump the liquid to at least a lower spray arm assembly 22. If the dishwasher has a mid-level spray arm assembly 23 and/or an upper spray arm assembly 24, liquid may be selectively pumped through a supply tube 25 to each of the assemblies for selective washing. As shown in FIG. 2, the supply tube 25 extends generally rearwardly from the pump assembly 21 to the rear wall 18 of the tub and extends upwardly to supply wash liquid to either of both of the mid-level and upper spray arm assemblies.

In the exemplary embodiment, the lower spray arm assembly 22 is positioned beneath a lower dish rack 26, the mid-level spray arm assembly 23 is positioned between an upper dish rack 27 and the lower dish rack 26, and the upper spray arm assembly 24 is positioned above the upper dish rack 27. As is typical in a conventional dishwasher, the lower spray arm assembly 22 is configured to rotate in the tub 12 and spray a flow of wash liquid, in a generally upward direction, over a portion of the interior of the tub 12. The spray from the lower spray arm 22 is typically directed to providing a wash for dishes located in the lower dish rack 26. Like the lower spray arm assembly 22, the mid-spray arm assembly 23 may also be configured to rotate in the dishwasher 10 and spray a flow of wash liquid, in a generally upward direction, over a portion of the interior of the tub 12. In this case, the spray from the mid-spray arm assembly 23 is directed to dishes in the upper dish rack 27. Typically, the upper spray arm assembly 24 generally directs a spray of wash water in a generally downward direction and helps wash dishes on both the upper and lower dish racks 26, 27. The spray of wash liquid from any one of these spray arm assemblies 22, 23, 24 or from all three in combination is considered to define a first "wash zone" 50.

In addition to one or more of the conventional spray arm wash assemblies described above, the present invention further comprises a second "wash zone", or more particularly, an intensified wash zone 28. While in the exemplary embodiment, the second wash zone 28 is located adjacent the lower dish rack 27 toward the rear of the tub 12, it could be located at virtually any location within the interior tub 12. The second wash zone 28 has been designed to allow heavily soiled dishes such as casserole dishes to receive the traditional spray arm wash, as well as, an additional concentrated wash action. Thus, a dishwasher having such a zone may not only provide better washing performance for heavily soiled dish ware, but may provide overall improved wash performance.

Figure 3:
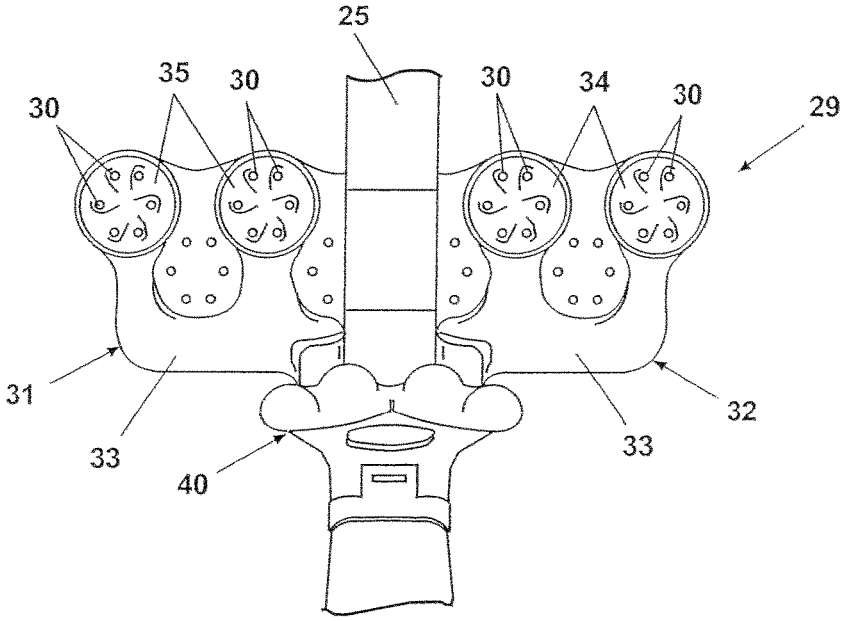
FIG. 3 is a front elevational view of a spray manifold in accordance with the exemplary embodiment of the present invention.

As illustrated in FIG. 3, the second wash zone 28 is achieved by selectively diverting wash liquid from the mid-level and upper spray arm assemblies 23, 24 to a vertically oriented spray manifold 29 positioned on the rear wall 18 of the interior tub 12 adjacent the lower dish rack 26. In this way, a flow of wash liquid is directed toward the lower dish rack 26 from the manifold 29 thereby providing the second wash zone 28. As one of skill in the art should recognize, the spray manifold 29 is not limited to this position, rather, the spray manifold 29 could be located in virtually any part of the interior tub 12. For example, the manifold 29 could be moved up vertically along any portion of the wash liquid supply tube 25 such as to a position adjacent the upper dish rack 27. Alternatively, the manifold 29 could be positioned underneath the lower dish rack 26 adjacent or beneath the lower spray arm assembly 22. The current positioning of the spray manifold 29 was chosen to allow for casserole dishes to be loaded in an upright position, which helps maximize or optimize amount of dishware that can be loaded in any given cycle.

In the exemplary embodiment, the spray manifold 29 is in fluid communication with the wash liquid supply tube 25 such that wash liquid may be selectively provided to the manifold 29. The manifold 29 is configured to have two symmetrically opposing halves 31, 32 positioned on opposite sides of the supply tube 25 with each half being configured to selectively receive wash liquid being pumped through the supply tube 25. Each half 31, 32 of the manifold 29 comprises a plurality of apertures 30 configured to spray wash liquid into the wash zone 28. Additionally, each half of the manifold is configured with one or more passageways 33 to deliver wash liquid from the supply tube 25 to the apertures 30. As one of skill in the art will appreciate, the wash liquid being pumped through the supply tube 25 will be under pressure as it passes through passageway 33 and out apertures 30, thereby creating an intensified wash zone 28.

As illustrated in FIG. 3, it is contemplated that each half 31, 32 of the spray manifold may comprise two substantially circular nozzles 34, 35 having a plurality of apertures 30 arranged in a substantially circular pattern. Each aperture 30 may be a substantially oval shape and may be provided at any angle with respect to the nozzle or with respect to the spray manifold 29. While the exemplary embodiment of the invention is illustrated in FIG. 3, the present invention is not meant to be limited by this illustration. For example, the spray manifold 29 may extend across virtually any width of the interior wash tub, or may be limited to extending to only one side of the supply tube 25. Moreover, the number of nozzles 34, 35 may vary, as well as the height and positioning of each nozzle. Additionally, the shape, size, angle, arrangement and number of apertures 30 in the manifold 29 may vary as alternative arrangements may provide a more concentrated wash zone. For example, not only can the manifold be configured to provide water flow to a particular area, but the water flow from the manifold may also be configured to have more speed or more volume per area.

As shown generally in FIG. 3 and more specifically in FIGS. 4*a* and 4*b*, a valve 40 may be provided to selectively divert wash liquid from the mid-level and upper spray arm assemblies 23, 24 to the spray manifold 29. In the exemplary embodiment, the valve 40 is a magnetically actuatable diverter valve positioned in the supply tube 25 and is configured to direct the flow of wash liquid either through the supply tube 25 so it can reach the mid-level and upper spray arm assemblies 23, 24 or through the spray manifold 29 so it can reach the intensified wash zone 28. As one of skill in the art should appreciate, the valve 40 could also be designed to selectively divert water from the lower spray arm 22.

In the exemplary embodiment, the valve 40 comprises a housing 43 and two diverter objects such as magnetic balls 41, 42 preferably having a ferrite core positioned within the housing and configured to be magnetically moved between a first position shown in FIG. 4*a* and a second position shown in FIG. 4*b*. In the first position, the diverter objects 41, 42 are magnetically positioned to substantially block passageway 33 associated with both halves 31, 32 of the spray manifold 29. In this way, wash liquid is prevented from entering the manifold 29 and is pushed through the supply tube 25 toward the mid-level and upper spray arm assemblies 23, 24. In the second position, the diverter objects 41, 42 are magnetically positioned to substantially block the supply tube 25, thereby allowing the wash liquid to enter both halves 31, 32 of the manifold 29 through passageway 33. While the exemplary embodiment contemplates that diverter valve 40 may the use of a plurality of magnetic objects such as magnetic balls to divert wash water between the mid-level and upper spray arm assemblies 23, 24 and the manifold 29, one of skill in the art will recognize that an arrangement of flapper valves, wedges, or other known water diverter mechanisms could be also be used.

As shown in FIG. 5, an actuator 44 is positioned outside of the housing 43 and behind the tub 12 for magnetically moving the objects 41, 42 from the first position to the second position and vice versa. In the exemplary embodiment, the actuator 44 comprises a magnet with sufficient strength to magnetically manipulate the diverter objects 41, 42. It should be recognized that the magnet could be a permanent magnet, electromagnet or any other type magnet configured to move the diverter objects 41, 42. The actuator 44 can be configured to be mounted to the outside 46 of the tub 12 in any variety of ways and can be configured to be in communication and controlled by the dishwasher's control panel (not shown) or the wash programs associated with the dishwasher 10. It should be recognized that to take advantage of the second wash zone 28, the dishwasher 10 might be configured with customized wash cycle options that provide for zone actuation at optimal cycle intervals.

The foregoing detailed description of the invention has been presented for purposes of illustration and description. It is not intended to be exhaustive nor limit the invention to the precise form disclosed. Many alternatives, modifications and variations have been discussed above, and others will be apparent to those skilled in the art in light of the above teaching.

We claim:

1. A dishwasher comprising:

a tub at least partially defining a wash chamber;

a lower dish rack located within the wash chamber;

an upper dish rack located within the wash chamber above the lower dish rack;

a lower rotating spray arm located within the wash chamber beneath the lower dish rack and configured to direct a spray of liquid into the wash chamber to define a first wash zone;

an upper rotating spray arm located within the wash chamber beneath the upper dish rack;

at least one nozzle having at least one aperture located in the wash chamber beneath the lower rotating spray arm and configured to direct a spray of liquid into the wash chamber to define a second wash zone which is more concentrated than the first wash zone;

a pump assembly in fluid communication with the tub to draw in liquid from the tub and comprising a pump output for outputting the drawn-in liquid; and a diverter valve fluidly coupling the pump to the lower rotating spray arm, upper rotating spray arm, and at least one nozzle, and selectively fluidly coupling the pump output to at least one of the lower rotating spray arm, the upper rotating spray arm, or the at least one nozzle.

2. The dishwasher of claim 1 wherein the diverter valve selectively couples the pump output to the at least one nozzle.

3. The dishwasher of claim 1 wherein the diverter valve selectively couples the pump output to the lower rotating spray arm.

4. The dishwasher of claim 1 wherein the diverter valve simultaneously couples the pump output to the lower rotating spray arm and the upper rotating spray arm.

5. The dishwasher of claim 1 wherein the diverter valve may be actuated to control the flow from the pump output of the pump assembly as follows:

a) to the at least one nozzle;

b) to the lower rotating spray arm; and c) to the upper rotating spray arm.

6. The dishwasher of claim 5 wherein the diverter valve may further be actuated to control the flow from the pump output of the pump assembly: d) simultaneously with the lower rotating spray arm and the upper rotating spray arm.

7. The dishwasher of claim 1 wherein the second wash zone overlaps the first wash zone.

8. The dishwasher of claim 1 wherein a portion of the second wash zone intersects a portion of the first wash zone beneath the lower basket.

9. The dishwasher of claim 1 and further comprising a door selectively closing an open face of the tub providing access to the wash chamber.

10. The dishwasher of claim 1, wherein the at least one nozzle is configured to emit liquid at a greater speed than the upper and lower rotating spray arms.

11. The dishwasher of claim 1, wherein the at least one nozzle is configured to emit liquid at more volume per area than the upper and lower rotating spray arms.

12. The dishwasher of claim 1, wherein the at least one nozzle is located toward a rear of the tub.

13. The dishwasher of claim 1 wherein the at least one nozzle has a circular shape.

14. The dishwasher of claim 13 wherein the at least one nozzle has multiple apertures.

15. The dishwasher of claim 1 wherein the diverter valve is located below the lower dish rack.

16. The dishwasher of claim 15 wherein the diverter valve is located adjacent a lower wall of the tub.

17. The dishwasher of claim 15 wherein the diverter valve is located in a rear half of the tub.

18. The dishwasher of claim 1 wherein the second wash zone completely overlaps the first wash zone.

19. The dishwasher of claim 18 wherein the second wash zone is more concentrated than the first wash zone.

20. A dishwasher comprising:

a tub at least partially defining a wash chamber;

a lower dish rack located within the wash chamber;

an upper dish rack located within the wash chamber above the lower dish rack;

a lower rotating spray arm located within the wash chamber beneath the lower dish rack and configured to direct a spray of liquid into the wash chamber to define a first wash zone;

an upper rotating spray arm located within the wash chamber beneath the upper dish rack;

at least one nozzle having at least one aperture located in the wash chamber beneath the lower rotating spray arm and configured to direct a spray of liquid into the wash chamber to define a second wash zone which at least partially overlaps with the first wash zone;

a pump assembly in fluid communication with the tub to draw in liquid from the tub and comprising a pump output for outputting the drawn-in liquid; and a diverter valve fluidly coupling the pump to the lower rotating spray arm, upper rotating spray arm, and at least one nozzle, and selectively fluidly coupling the pump output to at least one of the lower rotating spray arm, the upper rotating spray arm, or the at least one nozzle.

21. The dishwasher of claim 20 wherein the diverter valve selectively couples the pump output to the at least one nozzle.

22. The dishwasher of claim 20 wherein the diverter valve selectively couples the pump output to the lower rotating spray arm.

23. The dishwasher of claim 20 wherein the diverter valve simultaneously couples the pump output to the lower rotating spray arm and the upper rotating spray arm.

24. The dishwasher of claim 20 wherein the diverter valve may be actuated to control the flow from the pump output of the pump assembly as follows:

a) to the at least one nozzle;

b) to the lower rotating spray arm; and c) to the upper rotating spray arm.

25. The dishwasher of claim 24 wherein the diverter valve may further be actuated to control the flow from the pump output of the pump assembly: d) simultaneously with the lower rotating spray arm and the upper rotating spray arm.

26. The dishwasher of claim 20 wherein the second wash zone is more concentrated than the first wash zone.

27. The dishwasher of claim 20 wherein a portion of the second wash zone intersects a portion of the first wash zone beneath the lower basket.

28. The dishwasher of claim 20 wherein at least a portion of the second wash zone intersects the lower basket.

29. The dishwasher of claim 20 and further comprising a door selectively closing an open face of the tub providing access to the wash chamber.

30. The dishwasher of claim 20, wherein the upper rotating spray arm is positioned between the upper dish rack and the lower dish rack.

31. The dishwasher of claim 20, wherein the at least one nozzle is located toward a rear of the tub.

32. The dishwasher of claim 20 wherein the at least one nozzle has multiple apertures.

33. The dishwasher of claim 20 wherein the diverter valve is located below the lower dish rack.

34. The dishwasher of claim 33 wherein the diverter valve is located adjacent a lower wall of the tub.

35. The dishwasher of claim 33 wherein the diverter valve is located in a rear half of the tub.

* * * * *